US010566179B2

(12) United States Patent
Oshiro

(10) Patent No.: US 10,566,179 B2
(45) Date of Patent: Feb. 18, 2020

(54) TIME-OF-FLIGHT MASS SPECTROMETER

(71) Applicant: SHIMADZU CORPORATION, Kyoto-shi, Kyoto (JP)

(72) Inventor: Tomoyuki Oshiro, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/770,018

(22) PCT Filed: Oct. 23, 2015

(86) PCT No.: PCT/JP2015/080028
§ 371 (c)(1),
(2) Date: Apr. 20, 2018

(87) PCT Pub. No.: WO2017/068729
PCT Pub. Date: Apr. 27, 2017

(65) Prior Publication Data

US 2018/0315589 A1 Nov. 1, 2018

(51) Int. Cl.
*H01J 49/40* (2006.01)
*H01J 49/08* (2006.01)

(52) U.S. Cl.
CPC ..... *H01J 49/401* (2013.01); *H01J 49/08* (2013.01)

(58) Field of Classification Search
CPC ..... H01J 49/0009; H01J 49/401
See application file for complete search history.

(56) References Cited

U.S. PATENT DOCUMENTS

2008/0245962 A1 10/2008 Nakamura et al.
2010/0200742 A1 8/2010 Schultz et al.
2013/0134305 A1* 5/2013 Schultz ..... H01J 49/0045 250/282

FOREIGN PATENT DOCUMENTS

JP 2005-302622 A 10/2005
JP 2008-084850 A 4/2008
(Continued)

OTHER PUBLICATIONS

Communication dated Sep. 27, 2018, from European Patent Office in counterpart application No. 15906735.4.
(Continued)

*Primary Examiner* — Wyatt A Stoffa
(74) *Attorney, Agent, or Firm* — Sughrue Mion, PLLC

(57) ABSTRACT

An orthogonal acceleration time-of-flight (TOF) mass spectrometer in which an ion injected into an orthogonal acceleration area is periodically accelerated in a direction orthogonal to a direction of the injection and thereby ejected into a flight space. The mass spectrometer includes: an orthogonal acceleration electrode; a voltage supplier for applying a fixed level of voltage to the orthogonal acceleration electrode with a predetermined period; a TOF determiner for detecting an ion after a completion of a flight of the ion within the flight space, and determining the TOF of the ion; a storage section in which mass determination information defining a relationship between the TOF and mass-to-charge ratio of the ion depending on the period of the applied voltage is stored; and a mass-to-charge-ratio determiner for determining the mass-to-charge ratio of an ion from the TOF of the ion determined by the TOF determiner, based on the mass determination information.

3 Claims, 6 Drawing Sheets

| Measurement Time (min) | Mass Range to Be Measured | Period (μs) | Voltage (V) | | | | |
|---|---|---|---|---|---|---|---|
| | | | Ion Transport Electrode | Orthogonal Acceleration Electrode | Acceleration Electrode | Reflectron Electrode | Flight Tube |
| 0.0-6.0 | 100-2000 | 125 | B0 | A1 | C0 | D0 | E0 |
| 4.0-10.0 | 2000-10000 | 250 | B0 | A2 | C0 | D0 | E0 |
| 7.0-10.0 | 10000-40000 | 500 | B0 | A3 | C0 | D0 | E0 |

(56) References Cited

FOREIGN PATENT DOCUMENTS

| | | | |
|---|---|---|---|
| WO | 2010085720 | A1 | 7/2010 |
| WO | 2012/132550 | A1 | 10/2012 |

OTHER PUBLICATIONS

International Search Report for PCT/JP2015/080028 dated Dec. 15, 2015.
Written Opinion dated Dec. 15, 2015 in application No. PCT/JP2015/080028.
Communication dated Apr. 12, 2019 for corresponding Chinese Patent Application No. 201580084083.

* cited by examiner

Fig. 2

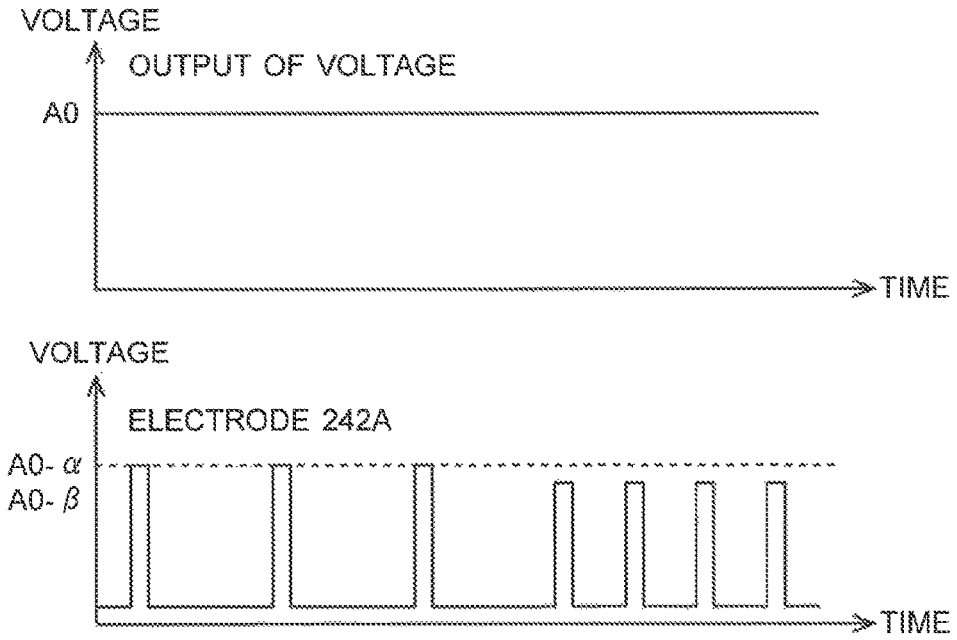

Fig. 3

| Period (μs) | Voltage (V) | | | | |
|---|---|---|---|---|---|
| | Ion Transport Electrode | Orthogonal Acceleration Electrode | Acceleration Electrode | Reflectron Electrode | Flight Tube |
| 125 | B0 | A1 | C0 | D0 | E0 |
| 250 | B0 | A2 | C0 | D0 | E0 |
| 500 | B0 | A3 | C0 | D0 | E0 |

Fig. 4

| | Retention Time (min) | Mass Range to Be Measured |
|---|---|---|
| Component A | 3.0 | 100-2000 |
| Component B | 5.0 | 100-10000 |
| Component C | 8.0 | 2000-40000 |

Fig. 5

| Measurement Time (min) | Mass Range to Be Measured | Period (μs) | Voltage (V) | | | | |
|---|---|---|---|---|---|---|---|
| | | | Ion Transport Electrode | Orthogonal Acceleration Electrode | Acceleration Electrode | Reflectron Electrode | Flight Tube |
| 0.0-6.0 | 100-2000 | 125 | B0 | A1 | C0 | D0 | E0 |
| 4.0-10.0 | 2000-10000 | 250 | B0 | A2 | C0 | D0 | E0 |
| 7.0-10.0 | 10000-40000 | 500 | B0 | A3 | C0 | D0 | E0 |

| Measurement Time (min) | Mass Range to Be Measured | Period (μs) | Voltage (V) | | | | |
|---|---|---|---|---|---|---|---|
| | | | Ion Transport Electrode | Orthogonal Acceleration Electrode | Acceleration Electrode | Reflectron Electrode | Flight Tube |
| 0.0-6.0 | 100-2000 | 125 | B0 | A0 | C0 | D0 | E0 |
| 4.0-10.0 | 2000-10000 | 250 | B0 | A0 | C0 | D0 | E0 |
| 7.0-10.0 | 10000-40000 | 500 | B0 | A0 | C0 | D0 | E0 |

TIME-OF-FLIGHT MASS SPECTROMETER

CROSS REFERENCE TO RELATED APPLICATIONS

This application is a National Stage of International Application No. PCT/JP2015/080028 filed Oct. 23, 2015.

TECHNICAL FIELD

The present invention relates to a time-of-flight mass spectrometer, and more specifically, to an orthogonal acceleration time-of-flight mass spectrometer (which may also be called a vertical acceleration time-of-flight mass spectrometer).

BACKGROUND ART

In a time-of-flight mass spectrometer (which is hereinafter called the "TOF-MS"), a fixed amount of kinetic energy is imparted, with a predetermined period, to ions derived from a sample component, to make those ions fly a specific distance within a space and determine the mass-to-charge ratio of each ion from its time of flight. If there is a variation in the initial energy (initial speed) of the ions, a variation in the time of flight occurs among the ions having the same mass-to-charge ratio, which causes a deterioration in the mass-resolving power. To solve this problem, TOF-MSs which employ an orthogonal acceleration system (which may also be called "vertical acceleration" or "orthogonal extraction") have been widely used (for example, see Patent Literature 1).

In the orthogonal acceleration TOF-MS, ions injected into an orthogonal accelerator section are given a fixed amount of energy with a predetermined period in a direction orthogonal to the direction of their injection, whereby a cluster of ions are ejected into a flight space. By accelerating the cluster of ions in a direction orthogonal to their incident direction, the orthogonal acceleration TOF-MS removes the influence of the variation in the time of flight due to the variation in the flight speed in the incident direction, and thereby improves the mass-resolving power.

In the orthogonal acceleration TOF-MS, a pair of electrodes are arranged within the orthogonal accelerator section in such a manner as to face each other across the area where ions are injected (orthogonal acceleration area). A pulsed voltage is applied to the pair of electrodes with the specific period mentioned earlier to eject ions into the flight space. The application of the pulsed voltage is performed, for example, by the switching of a voltage applied from a power source. The period with which the ions are ejected by the application of the pulsed voltage (which corresponds to the specific period mentioned earlier) is set so that the period will be longer than the time of flight of an ion having a mass-to-charge ratio which corresponds to the upper limit of the mass range to be measured in the TOF-MS.

The orthogonal acceleration TOF-MS is often used in combination with a liquid chromatograph or gas chromatograph. In such a chromatograph mass spectrometer, a plurality of target components temporally separated by the column of the chromatograph are introduced into the orthogonal acceleration TOF-MS and sequentially subjected to mass spectrometry. In this case, each target component generates different kinds of ions, and those ions have different mass-to-charge ratios. Therefore, the mass range to be measured is set for each target component, and the pulsed voltage is applied with a period corresponding that mass range to eject the ions into the flight space.

CITATION LIST

Patent Literature

Patent Literature 1: WO 2012/132550 A

SUMMARY OF INVENTION

Technical Problem

Since each of the pair of electrodes mentioned earlier has a stray capacity, the amount of electric current changes depending on the period (interval) of the application of the pulsed voltage. Therefore, even when a fixed level of voltage is applied, a voltage drop occurs at those electrodes with a magnitude which depends on that period. This means that the amount of energy imparted to each ion changes depending on the aforementioned period, which results in a change in the time of flight of the ion. As noted earlier, TOF-MSs determine the mass-to-charge ratio of an ion based on its time of flight. Therefore, a change in the time of flight of an ion causes a shift of the mass-to-charge ratio and consequently deteriorates the mass accuracy of the measured result.

The problem to be solved by the present invention is to provide an orthogonal acceleration time-of-flight mass spectrometer in which the mass accuracy of the measured result will not deteriorate even when the period of the application of the voltage to the electrodes for imparting energy to make ions fly into the flight space is changed.

Solution to Problem

The first aspect of the present invention developed for solving the previously described problem is an orthogonal acceleration time-of-flight mass spectrometer in which an ion injected into an orthogonal acceleration area is accelerated in a direction orthogonal to the direction of the injection and thereby periodically ejected into a flight space, and the mass-to-charge ratio of the ion is determined based on the time of flight of the ion within the flight space, the mass spectrometer including:

a) an ion transport electrode for transporting an ion into the orthogonal acceleration area;

b) an orthogonal acceleration electrode including a pair of electrodes arranged in such a manner as to face each other across the orthogonal acceleration area, for accelerating an ion injected into the orthogonal acceleration area, in a direction orthogonal to the direction of the injection;

c) a flight-path-defining electrode including a flight tube arranged on an outer edge of the flight space;

d) a storage section in which applied-voltage information which is a set of information concerning the levels of voltages applied to the orthogonal acceleration electrode, the ion transport electrode, and the flight-path-defining electrode is stored, where an applied voltage whose level changes depending on an ion-ejection period is related to at least the orthogonal acceleration electrode, the ion transport electrode, or the flight-path-defining electrode in the applied-voltage information; and e) a voltage supplier for applying voltages to the orthogonal acceleration electrode, the ion transport electrode, and the flight-path-defining electrode, based on the applied-voltage information.

The applied-voltage information can be prepared by performing a preliminary experiment with a plurality of different periods to determine, for each of the orthogonal acceleration electrode, ion transport electrode and flight-path-defining electrode, a voltage value at which ions having the same mass-to-charge ratio will be detected with the same time of flight after flying in the flight space. More specifically, the applied-voltage information can be prepared by experimentally determining a voltage value which accelerates or decelerates ions in such a manner as to cancel the change in the amount of energy imparted to the ions due to a voltage drop which occurs at the pair of electrodes included in the orthogonal acceleration electrode with a magnitude which depends on the ion-ejection period.

In the orthogonal acceleration time-of-flight mass spectrometer according to the present invention, the voltage supplier applies a voltage whose level depends on the ion-ejection period, to at least the orthogonal acceleration electrode, ion transport electrode, or flight-path-defining electrode, based on the applied-voltage information previously stored in the storage section.

By applying a different level of voltage to the orthogonal acceleration electrode according to the ion-ejection period, the amount of energy imparted to the ions can be maintained at a fixed level even when the measurement is performed with a different ion-ejection period.

By applying a different level of voltage to the ion transport electrode according to the ion-ejection period, the position of the injection of the ion within the orthogonal acceleration area changes, whereby the change in the time of flight due to the difference in the amount of energy imparted to the ion in the orthogonal accelerator section can be canceled.

By applying a different level of voltage to the flight-path-defining electrode according to the ion-ejection period, the way of the acceleration or deceleration of the ion can be changed according to the ion-ejection period, whereby the change in the time of flight due to the difference in the amount of energy imparted to the ion in the orthogonal accelerator section can be canceled.

Accordingly, the mass accuracy of the measured result will not deteriorate.

For example, the applied-voltage information may be a table in which a value of the applied voltage is related to each of a plurality of periods, or a mathematical formula for calculating the value of the applied voltage using the ion-ejection period as a variable.

The previously described time-of-flight mass spectrometer may preferably include an acceleration electrode including a plurality of electrodes for accelerating an ion traveling from the orthogonal acceleration electrode toward the flight space. In this mode of the time-of-flight mass spectrometer, an applied voltage whose level changes depending on the ion-ejection period can be related to the acceleration electrode so as to accelerate or decelerate ions according to the ion-ejection period and thereby cancel the change in the time of flight.

The ion transport electrode is an electrode for converging ions flying toward the orthogonal acceleration area. For example, this electrode may be formed by a plurality of ring-shaped electrodes each of which is arranged in such a manner as to surround the axis of incidence of the ion.

In the case of a reflectron TOF-MS, the flight-path-defining electrode includes a reflectron electrode for returning ions flying in the flight space, in addition to the flight tube.

The second aspect of the present invention developed for solving the previously described problem is an orthogonal acceleration time-of-flight mass spectrometer in which an ion injected into an orthogonal acceleration area is accelerated in a direction orthogonal to the direction of the injection and thereby periodically ejected into a flight space, and the mass-to-charge ratio of the ion is determined based on the time of flight of the ion within the flight space, the mass spectrometer including:

a) an orthogonal acceleration electrode arranged in such a manner as to face each other across an axis of incidence of the injected ion;

b) a voltage supplier for applying a fixed level of voltage to the orthogonal acceleration electrode with a predetermined period;

c) a time-of-flight determiner for detecting an ion after the completion of a flight of the ion within the flight space, and determining the time of flight of the ion;

d) a storage section in which mass determination information which is a set of information defining the relationship between the time of flight and mass-to-charge ratio of the ion depending on the period of the applied voltage is stored; and e) a mass-to-charge-ratio determiner for determining the mass-to-charge ratio of an ion from the time of flight of the ion determined by the time-of-flight determiner, based on the mass determination information.

The mass determination information can be prepared based on the result of a preliminary experiment the time of flight of an ion having a known mass-to-charge ratio is determined with a plurality of different periods while a fixed level of voltage is applied to the orthogonal acceleration electrode.

As noted earlier, a voltage drop occurs at the orthogonal acceleration electrode with a magnitude which depends on the period of the applied voltage, so that the amount of energy imparted to the ions also changes. Consequently, the time of flight of an ion changes depending on the period of the applied voltage even when there is no change in the mass-to-charge ratio of the ion. In the second mode of the time-of-flight mass spectrometer, the mass determination information in which the relationship between the time of flight and mass-to-charge ratio of an ion is defined depending on the period of the applied voltage is used to determine the mass-to-charge ratio of an ion, whereby the influence of the change in the time of flight of the ion is removed. Therefore, the mass accuracy of the measured result will not deteriorate even when the period of the applied voltage is changed.

Advantageous Effects of the Invention

In the orthogonal acceleration time-of-flight mass spectrometer according to the first or second aspect of the present invention, the influence of the voltage drop which occurs with a magnitude that depends on the period of the applied voltage is removed by using the information showing the level of the applied voltage depending on the period (applied-voltage information) or information showing the relationship between the time of flight and mass-to-charge ratio depending on the period (mass determination information). Therefore, the mass accuracy of the measured result will not deteriorate even when the period of the applied voltage is changed.

BRIEF DESCRIPTION OF DRAWINGS

FIG. 2 is a diagram illustrating the voltage drop at the orthogonal acceleration electrode in a conventional orthogonal acceleration time-of-flight mass spectrometer.

FIG. 3 is one example of the applied-voltage information in the first embodiment.

FIG. 4 is one example of the retention times and mass ranges to be measured for the components in a sample to be entered by a user.

FIG. 5 is one example of the measurement conditions in the first embodiment.

DESCRIPTION OF EMBODIMENTS

The time-of-flight mass spectrometer according to the present invention is an orthogonal acceleration time-of-flight mass spectrometer (TOF-MS). This device applies a pulsed voltage with a predetermined period to a pair of electrodes arranged in an orthogonal accelerator section to eject ions into a flight space, and determines the mass-to-charge ratio of each ion from its time of flight within the flight space.

In the orthogonal TOF-MS, a voltage drop occurs in the orthogonal accelerator section with a magnitude which depends on the period of the voltage applied to the pair of electrodes. The present invention has been developed to prevent the mass accuracy of the measured result from deteriorating due to a change in the amount of kinetic energy imparted to the ions caused by the voltage drop. The present invention is characterized by a means for compensating for the influence of the voltage drop by the level of an applied voltage or by the relationship between the time of flight and mass-to-charge ratio. Its specific embodiments are hereinafter described with reference to the attached drawings.

First Embodiment

The first embodiment is a liquid chromatograph mass spectrometer including one embodiment of the time-of-flight mass spectrometer according to the present invention. The mass spectrometer in the present embodiment is an orthogonal acceleration reflectron TOF-MS.

Figure 1:
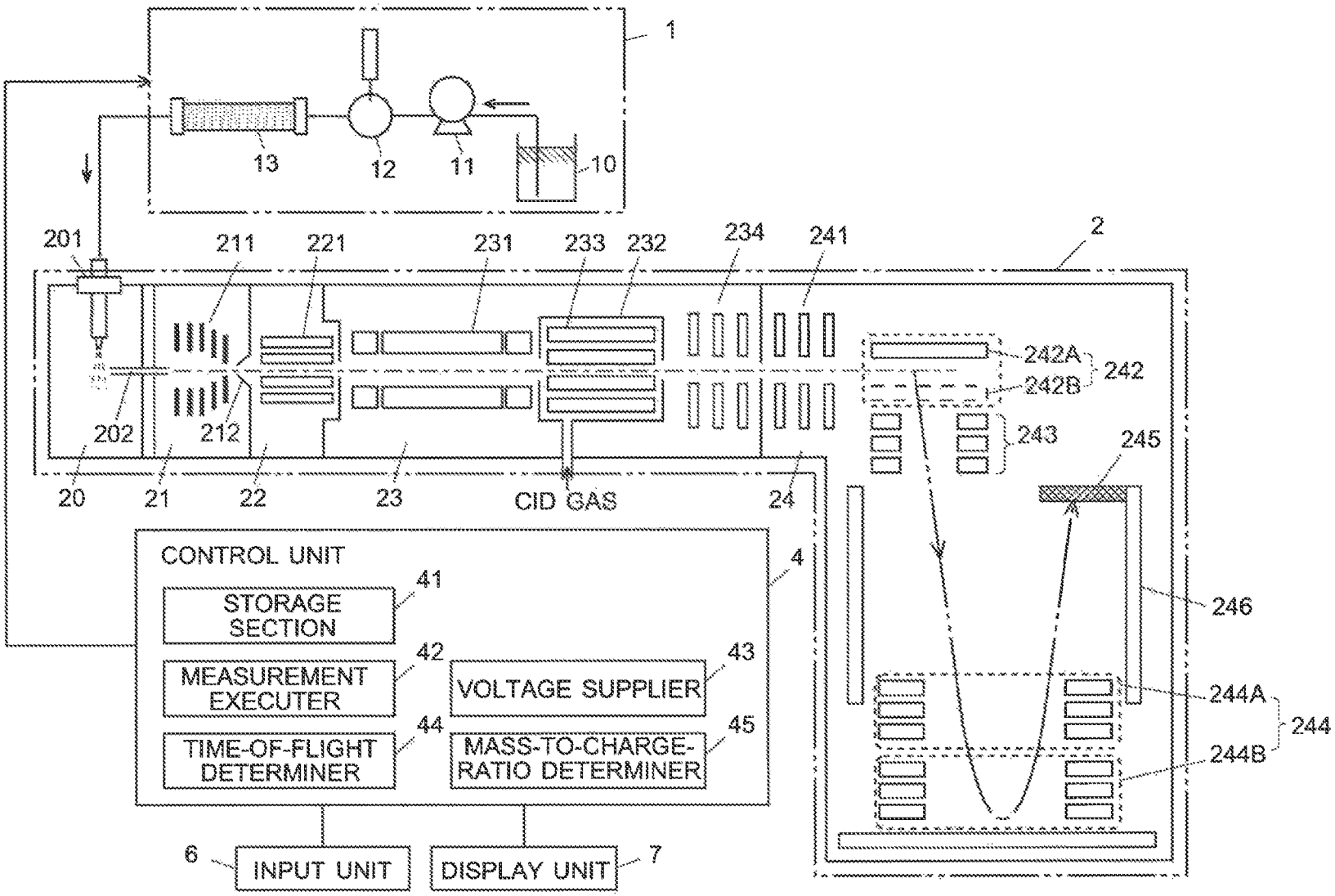
FIG. 1 is a configuration diagram of the main components of a liquid chromatograph mass spectrometer including one embodiment of the orthogonal acceleration time-of-flight mass spectrometer according to the present invention.

As shown in FIG. 1, the liquid chromatograph mass spectrometer in the first embodiment includes a liquid chromatograph unit 1, mass spectrometer unit 2, and control unit 4 controlling the operations of those units.

In the liquid chromatograph mass spectrometer of the first embodiment, the liquid chromatograph unit 1 includes a mobile phase container 10 in which a mobile phase is stored, a pump 11 for drawing the mobile phase and supplying it at a fixed flow rate, an injector 12 for injecting a predetermined amount of sample liquid into the mobile phase, and a column 13 for temporally separating various compounds contained in the sample liquid.

The mass spectrometer unit 2 has the configuration of a multi-stage differential pumping system including an ionization chamber 20 maintained at approximately atmospheric pressure and an analysis chamber 24 evacuated to a high degree of vacuum by a vacuum pump (not shown), between which first, second and third intermediate chambers 21, 22 and 23 are provided having their degrees of vacuum increased in a stepwise manner. The ionization chamber 20 is provided with an electrospray ionization probe (ESI probe) 201 for spraying a sample solution eluted from the column 13 of the liquid chromatograph unit 1, while imparting electric charges to the same solution.

The ionization chamber 20 communicates with the first intermediate chamber 21 through a heated thin capillary 202. The first intermediate chamber 21 is separated from the second intermediate chamber 22 by a skimmer 212 having a small hole at its apex. The first and second intermediate chambers 21 and 22 respectively contain ion guides 211 and 221 for transporting ions to the next stage while converging the ions. The third intermediate chamber 23 contains a quadrupole mass filter 231 for separating ions according to their mass-to-charge ratios, a collision cell 232 containing a multipole ion guide 233, and an ion guide 234 for transporting ions ejected from the collision cell 232. A CID gas, such as argon or nitrogen, is continuously or intermittently supplied into the collision cell 232.

The analysis chamber 24 contains: an ion transport electrode 241 for receiving ions from the third intermediate chamber 23 and transporting them to the orthogonal accelerator section; an orthogonal acceleration electrode 242 including two electrodes 242A and 242B arranged in such a manner as to face each other across the axis of incidence of the ions (orthogonal acceleration area); an acceleration electrode 243 for accelerating ions ejected into the flight space by the orthogonal acceleration electrode 242; a reflectron electrode 244 (244A and 244B) for forming a return path for the ions within the flight space; a detector 245; and a flight tube 246 located on the outer edge of the flight space. The reflectron electrode 244 and the flight tube 246 correspond to the flight-path-defining electrode in the present invention.

In the mass spectrometer unit 2, an MS scan measurement, MS/MS scan measurement, or $MS^n$ scan measurement (where n is an integer equal to or greater than three) can be performed. For example, in the case of the MS/MS scan measurement (product ion scan measurement), only an ion designated as the precursor ion is allowed to pass through the quadrupole mass filter 231. Additionally, a CID gas is supplied into the collision cell 232 to fragment the precursor ion into product ions. The product ions are introduced into the flight space, and the mass-to-charge ratios of the ions are determined based on their respective times of flight.

The control unit 4 has a storage section 41 and the following functional blocks: a measurement executer 42, voltage supplier 43, time-of-flight determiner 44, and mass-to-charge-ratio determiner 45. The same unit also has the function of controlling the operations of relevant elements in the liquid chromatograph unit 1 and the mass spectrometer unit 2. The control unit 4 is actually a personal computer, which can be made to function as the aforementioned components by executing a program previously installed on the computer. Additionally, an input unit 6 and display unit 7 are connected to the control unit 4.

In the storage section 41, time-of-flight-vs-mass-to-charge-ratio information and applied-voltage information are stored. Time-of-flight-vs-mass-to-charge-ratio information is a set of information describing the length of time required for each of the ions with various mass-to-charge ratios to fly in the flight space in the mass spectrometer unit 2. Applied-voltage information is a set of information concerning the values of the voltages applied to the ion transport electrode 241, orthogonal acceleration electrode 242, acceleration electrode 243, reflectron electrode 244, and flight tube 246. In the present embodiment, a plurality of different levels of the applied voltage depending on the ion-ejection period is related to the orthogonal acceleration electrode 242.

A description of the applied-voltage information is hereinafter given: The orthogonal acceleration electrode 242 contained within the analysis chamber 24 has a stray capacity, which causes the amount of electric current to change depending on the period (interval) of the application of the pulsed voltage. Therefore, as shown in FIG. 2, even when a fixed level of voltage A0 is applied, a voltage drop occurs at each of the electrodes 242A and 242B with a magnitude which depends on that period. The applied-voltage information used in the present embodiment is a set of information in which the period of the applied voltage is related to the level of the same voltage based on the result of a preliminary experiment in such a manner as to compensate for the voltage drop so that a fixed amount of energy will be imparted to the ions, whichever period of the applied voltage is used. In the present embodiment, a table as shown in FIG. 3 is used, in which different values of the applied voltage (A1, A2 and A3) are respectively related to three ion-ejection periods (125 μs, 250 μs and 500 μs).

A method for mass spectrometry in the present embodiment is hereinafter described. In the present example, three target components (A, B and C) contained in a sample are temporally separated by the column 13 in the liquid chromatograph unit 1, and those components are sequentially subjected to mass spectrometry in the mass spectrometer unit 2.

A user initially enters the retention time and the mass range to be measured for each component contained in the sample through the input unit 6 (FIG. 4). In the present embodiment, the following values are entered: For component A, the retention time is 3.0 min, and the mass range to be measured is 100-2000. For component B, the retention time is 5.0 min, and the mass range to be measured is 100-10000. For component C, the retention time is 8.0 min, and the mass range to be measured is 2000-40000.

Subsequently, the measurement executer 42 refers to the time-of-flight-vs-mass-to-charge-ratio information and calculates, for each of the components A, B and C, the length of time required for an ion having the largest mass-to-charge ratio within the mass range to be measured to fly from the orthogonal acceleration electrode 242 to the detector 245. Then, the measurement executer 42 determines which of the three periods of the applied voltage described in the applied-voltage information is longer than and the closest to the calculated length of time. In the present embodiment, 125 μs, 250 μs and 500 μs are selected as the voltage application periods for components A, B and C, respectively. For ions having short times of flight (i.e. ions having small mass-to-charge ratios), a longer period than the one determined by the previously described steps may be used to accumulate a greater amount of ions within an ion trap and thereby improve the use efficiency of the ions.

After the period of the applied voltage in the measurement of each component has been determined, the measurement executer 42 determines measurement conditions, creates a file describing the conditions, and stores it in the storage section 41. Specifically, for each component entered by the user, the measurement conditions are determined by initially determining a measurement time corresponding to the retention time of the component, and then relating the mass range to be measured, period of the applied voltage, level of the applied voltage and other relevant items of information to that measurement time (FIG. 5).

More specifically, in the present embodiment, a measurement for detecting ions having mass-to-charge ratios of 100-2000 while ejecting ions with a period of 125 μs is repeated within a measurement time of 0.0-4.0 minutes. The measured result is provided as an output after being accumulated a predetermined number of times (e.g. 50 times).

Within a measurement time of 4.0-6.0 minutes, a series of measurements which include one measurement repeated a predetermined number of times, followed by another measurement repeated a predetermined number of times, is handled as one set, and this set of measurements is repeatedly performed. In the first measurement, ions having mass-to-charge ratios of 100-2000 are detected while ions are ejected with a period of 125 μs. In the second measurement, ions having mass-to-charge ratios of 2000-10000 are detected while ions are ejected with a period of 250 μs.

Figure 6:
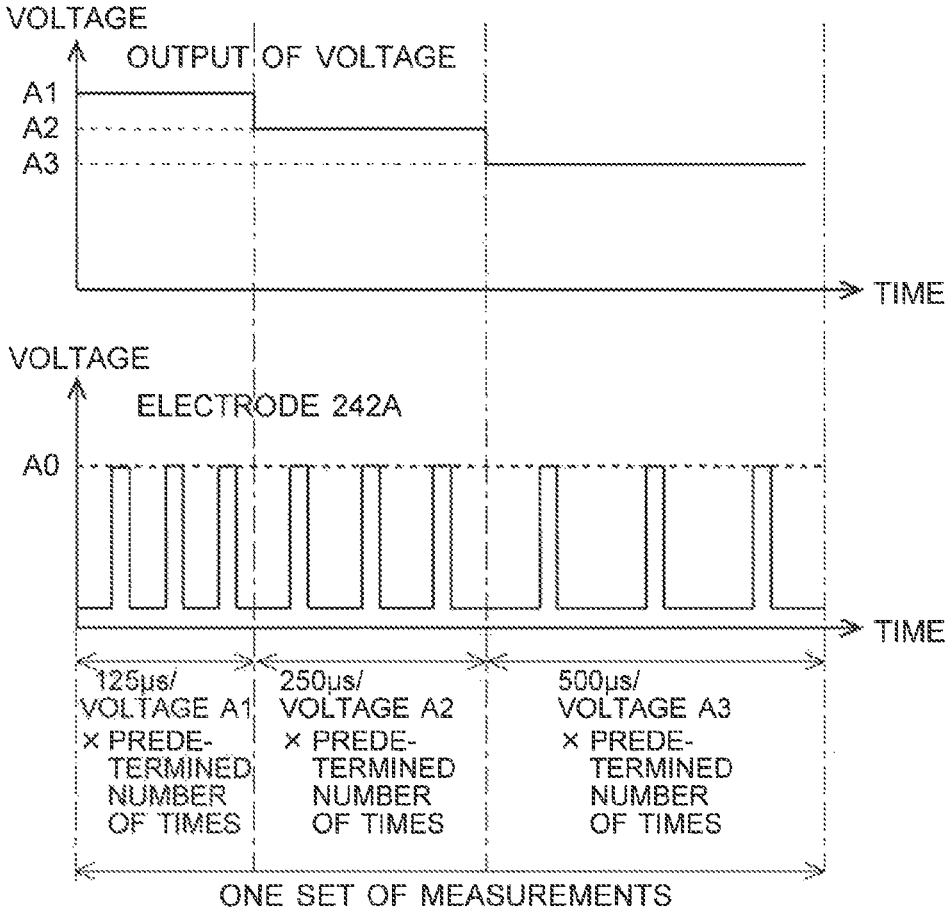
FIG. 6 is a diagram illustrating the applied voltage at the orthogonal acceleration electrode in the orthogonal acceleration time-of-flight mass spectrometer in the first embodiment.

Within a measurement time of 6.0-7.0 minutes, a series of measurements which include one measurement repeated a predetermined number of times, which is followed by another measurement repeated a predetermined number of times, which is followed by still another measurement repeated a predetermined number of times, is handled as one set, and this set of measurements is repeatedly performed. In the first measurement, ions having mass-to-charge ratios of 100-2000 are detected while ions are ejected with a period of 125 μs. In the second measurement, ions having mass-to-charge ratios of 2000-10000 are detected while ions are ejected with a period of 250 μs. In the third measurement, ions having mass-to-charge ratios of 10000-40000 are detected while ions are ejected with a period of 500 μs. The lower section of FIG. 6 shows one set of measurements repeated within the measurement time of 6.0-7.0 minutes.

Similarly, within a measurement time of 7.0-10.0 minutes, a series of measurements including two measurements with different periods (250 μs and 500 μs), each measurement repeated a predetermined number of times, is handled as one set, and this set of measurements is repeatedly performed.

For ease of explanation, only some of the items of the measurement conditions have been mentioned in the previous description. There are also other items to be determined, such as the mass-to-charge ratio of the precursor ion of each component and the level of collision energy in the collision cell, in addition to the items shown in FIG. 5. After the measurement condition file has been created, the measurement executor 42 displays, on the display unit 7, a screen for urging the user to issue a command to initiate the analysis.

When the command to initiate the analysis is issued by the user, the measurement executer 42 controls relevant components in the liquid chromatograph unit 1 and the mass spectrometer unit 2 based on the description in the measurement condition file to perform the analysis. The voltage supplier 43 applies voltages to relevant elements based on the applied-voltage information mentioned earlier. During the analysis, the product ions generated from the precursor ion of each component are detected. After the completion of the analysis, the time-of-flight determiner 44 determines the time of flight of each detected product ion based on the ion detection signal in the detector 245. The mass-to-charge-ratio determiner 45 determines the mass-to-charge ratio of each product ion based on the time-of-flight-vs-mass-to-charge-ratio information stored in the storage section 41.

As described thus far, in the liquid chromatograph mass spectrometer according to the first embodiment, a voltage whose level has been determined considering the influence of the voltage drop which occurs with a magnitude that depends on the period of the applied voltage is applied from the power source to the orthogonal acceleration electrode 242. A fixed amount of energy can thereby be imparted to the ions to eject them into the flight space, whichever period of the applied voltage is used (FIG. 6). Therefore, the mass accuracy of the measured result will not deteriorate even when the period of the applied voltage is changed.

The applied-voltage information used in the first embodiment is in the form of a table in which a level of applied voltage is related to each of the three predetermined periods. Other forms of information may also be used, such as a graph or mathematical formula which relates the period of the applied voltage to the level of the voltage.

In the first embodiment, the level of the voltage applied to the orthogonal acceleration electrode 242 is changed according to the ion-ejection period. It is also possible to similarly obtain the previously described effect by changing the level of the voltage applied to any of the other electrodes (ion transport electrode 241, acceleration electrode 243, and flight tube 246) according to the ion-ejection period.

Normally, when ions are injected into the orthogonal acceleration area, the same voltage is applied to the ion transport electrode 241 as well as the electrodes 242A and 242B of the orthogonal acceleration electrode 242. Now, suppose that the same voltage is applied to the ion transport electrode 241 and the electrode 242A while the voltage applied to the electrode 242B is set at a lower level (with a smaller absolute value) than the voltage applied to the two aforementioned electrodes (it should be noted that all voltages applied have the same polarity as the ion). In this situation, ions gradually come closer to the electrode 242B when entering the orthogonal acceleration area. Consequently, the time of flight of the ions will be shorter. Accordingly, a decrease in the amount of energy imparted to the ions (which causes the time of flight of the ions to be longer) can thereby be canceled. An increase in the amount of energy imparted to the ions (which causes the time of flight of the ions to be shorter) can also be canceled by applying the same voltage to the ion transport electrode 241 and the electrode 242B while applying a lower voltage to the electrode 242A than the voltage applied to the two aforementioned electrodes.

If the level of the voltage applied to the acceleration electrode 243 is changed, a change occurs in the amount of energy to be imparted to the ions which have been ejected from the orthogonal acceleration electrode 242 into the flight space. Accordingly, it is possible to similarly obtain the previously described effect by applying a different level of voltage to the acceleration electrode 243 according to the ion-ejection period.

If the level of the voltage applied to the flight tube 246 is changed, a change occurs in the potential difference between the ion entrance section (the end of the acceleration electrode 243 facing the ion flight space) and the outer edge of the ion flight space (the entrance end of the flight tube 246). Accordingly, it is possible to similarly obtain the previously described effect by applying a different level of voltage to the flight tube 246 according to the ion-ejection period.

If level of the voltage applied to the reflectron electrode 244 is changed, a change occurs the gradient of the returning electric field created within the ion flight space. This means a change in the form of deceleration and acceleration of the ions within the reflectron electrode 244, as well as a consequent change in the time of flight of the ions. Accordingly, it is possible to similarly obtain the previously described effect by applying a different level of voltage to the reflectron electrode 244 according to the ion-ejection period.

As just described, the voltage drop which occurs at the orthogonal acceleration electrode 242 can be canceled by changing the voltage applied to one of the electrodes constituting the TOF-MS according to the ion-ejection period. However, the acceleration electrode 243, reflectron electrode 244 and flight tube 246 normally require voltages to be constantly applied at high levels of several thousand volts. It is difficult to change the value of such a voltage by a small amount during the measurement and precisely control its level. By comparison, the voltages constantly applied to the ion transport electrode 241 and the orthogonal acceleration electrode 242 (electrodes 242A and 242B) are normally at levels of several ten volts (although the pulsed voltage instantly applied to the electrodes 242A and 242B to orthogonally accelerate ions is at a level of several thousand volts). Therefore, it is preferable to change the level of the voltage applied to one of these electrodes according to the ion-ejection period.

Second Embodiment

Figure 7:
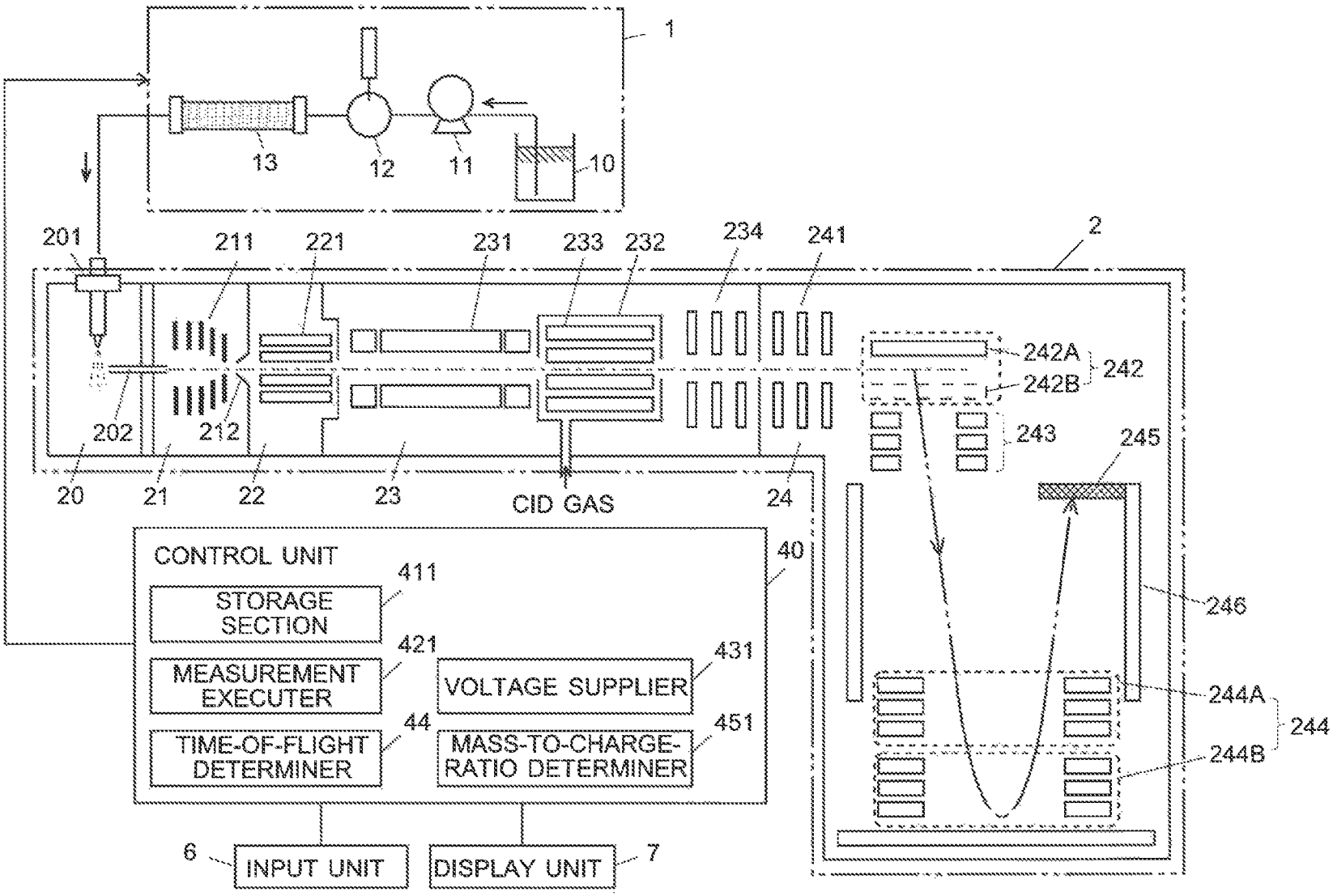
FIG. 7 is a configuration diagram of the main components of a liquid chromatograph mass spectrometer including another embodiment of the orthogonal acceleration time-of-flight mass spectrometer according to the present invention.

A liquid chromatograph mass spectrometer according to the second embodiment is hereinafter described. FIG. 7 shows the configuration of its main components. The configurations of the liquid chromatograph unit 1 and the mass spectrometer unit 2 are the same as in the first embodiment, and therefore, will not be described. The following description is mainly concerned with the configuration of the control unit 40.

The control unit 40 has a storage section 411 and the following functional blocks: a measurement executer 421, voltage supplier 431, time-of-flight determiner 44, and mass-to-charge-ratio determiner 451. As in the first embodiment, the same unit also has the function of controlling the operations of relevant elements in the liquid chromatograph unit 1 and the mass spectrometer unit 2. The control unit 4 is actually a personal computer, to which an input unit 6 and display unit 7 are connected.

In the storage section 411, time-of-flight-vs-mass-to-charge-ratio information which is different from the one in the first embodiment is stored. In the second embodiment, different kinds of time-of-flight-vs-mass-to-charge-ratio information are used according to the period of the applied voltage.

Figures 8, 9:
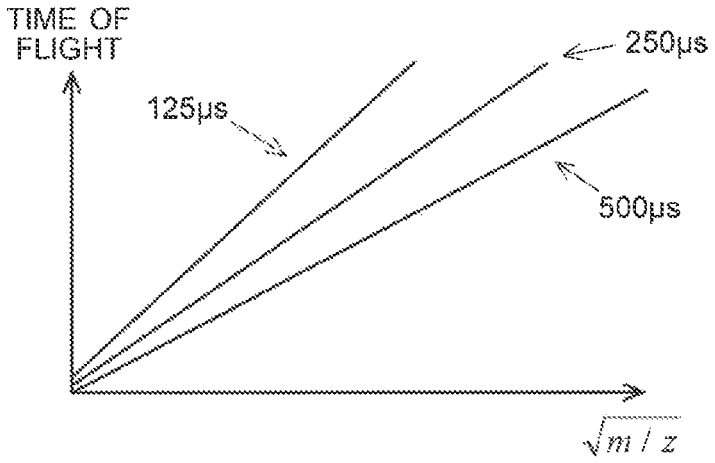
FIG. 8 is one example of the time-of-flight-vs-mass-to-charge-ratio information in the second embodiment.
FIG. 9 is one example of the measurement conditions in the second embodiment.

As already explained with reference to FIG. 2, even when a fixed level of voltage A0 is applied from the power source to the orthogonal acceleration electrode 242, the amount of kinetic energy imparted to the ions changes since a voltage drop occurs at the electrodes 242A and 242B with a magnitude which depends on the period of the voltage. As a result, the time of flight of the ions varies depending on the period of the applied voltage. In the second embodiment, the time-of-flight-vs-mass-to-charge-ratio information as shown in FIG. 8 is used which has been prepared taking into account the amount of change in the time of flight of the ions which occurs depending on the period of the applied voltage. Other than the graphical form as shown in FIG. 8, various forms of time-of-flight-vs-mass-to-charge-ratio information can be used in the present embodiment, such as a table or mathematical formula. It may also be a form of information for correcting the mass axis of a mass spectrum according to the period of the applied voltage.

A method for mass spectrometry in the present embodiment is hereinafter described. As in the first embodiment, three target components (A, B and C) contained in a sample are temporally separated by the column 13 in the liquid chromatograph unit 1, and those components are sequentially subjected to mass spectrometry in the mass spectrometer unit 2.

A user initially enters the retention time and the mass range to be measured for each component contained in the sample through the input unit 6 (FIG. 4). In the present embodiment, the following values are entered: For component A, the retention time is 3.0 min, and the mass range to be measured is 100-2000. For component B, the retention time is 5.0 min, and the mass range to be measured is 100-10000. For component C, the retention time is 8.0 min, and the mass range to be measured is 2000-40000.

Subsequently, the measurement executer 421 refers to the time-of-flight-vs-mass-to-charge-ratio information and calculates, for each of the components A, B and C, the length of time required for an ion having the largest mass-to-charge ratio within the mass range to be measured to fly from the orthogonal acceleration electrode 242 to the detector 245. Then, the measurement executer 421 determines which of the three previously determined periods of the applied voltage (125 μs, 250 μs and 500 μs) is longer than and the closest to the calculated length of time. In the present embodiment, 125 μs, 250 μs and 500 μs are selected as the voltage application periods for components A, B and C, respectively. The time-of-flight-vs-mass-to-charge-ratio information to be referenced in the present step may be any one of the three kinds of time-of-flight-vs-mass-to-charge-ratio information. However, it is preferable to use the one in which the longest time of flight is related to the same mass-to-charge ratio of the ion (i.e. the time-of-flight-vs-mass-to-charge-ratio information prepared for a period of 125 μm, in which the largest voltage drop occurs and the smallest amount of energy is imparted to the ions).

After the period of the applied voltage in the measurement of each component has been determined, for each component entered by the user, the measurement executer 421 determines the measurement conditions by initially determining a measurement time corresponding to the retention time of the component, and then relating the mass range to be measured, period of the applied voltage, level of the applied voltage and other relevant items of information to that measurement time (FIG. 9). In the second embodiment, a fixed level of voltage A0 is applied to the orthogonal acceleration electrode 242 regardless of the period of the applied voltage.

After the measurement conditions for all components have been determined, the measurement executer 421 creates the measurement condition file and stores it in the storage section 411. Then, the measurement executor 421 displays, on the display unit 7, a screen for urging the user to issue a command to initiate the analysis. When the command to initiate the analysis is issued by the user, the measurement executer 421 controls relevant components in the liquid chromatograph unit 1 and the mass spectrometer unit 2 based on the description in the measurement condition file to perform the analysis.

After the completion of the analysis, the time-of-flight determiner 44 determines the time of flight of each of the product ions generated from each component, based on the period of the applied voltage as well as the ion detection signal from the detector 245.

Subsequently, the mass-to-charge-ratio determiner 451 determines the mass-to-charge ratio of each product ion using the time-of-flight-vs-mass-to-charge-ratio information which corresponds to the period of the applied voltage used in the segment of time in which the ion concerned was detected, among the three kinds of time-of-flight-vs-mass-to-charge-ratio information stored in the storage section 41. As described earlier, the time-of-flight-vs-mass-to-charge-ratio information in the present embodiment is prepared taking into account the fact that the amount of energy imparted to the ions changes due to the voltage drop which occurs depending on the period of the applied voltage. Therefore, the mass-to-charge ratio can be correctly determined, whichever period of the applied voltage is used.

Any of the previous embodiments is a mere example and can be appropriately modified within the spirit of the present invention.

Figure 10:
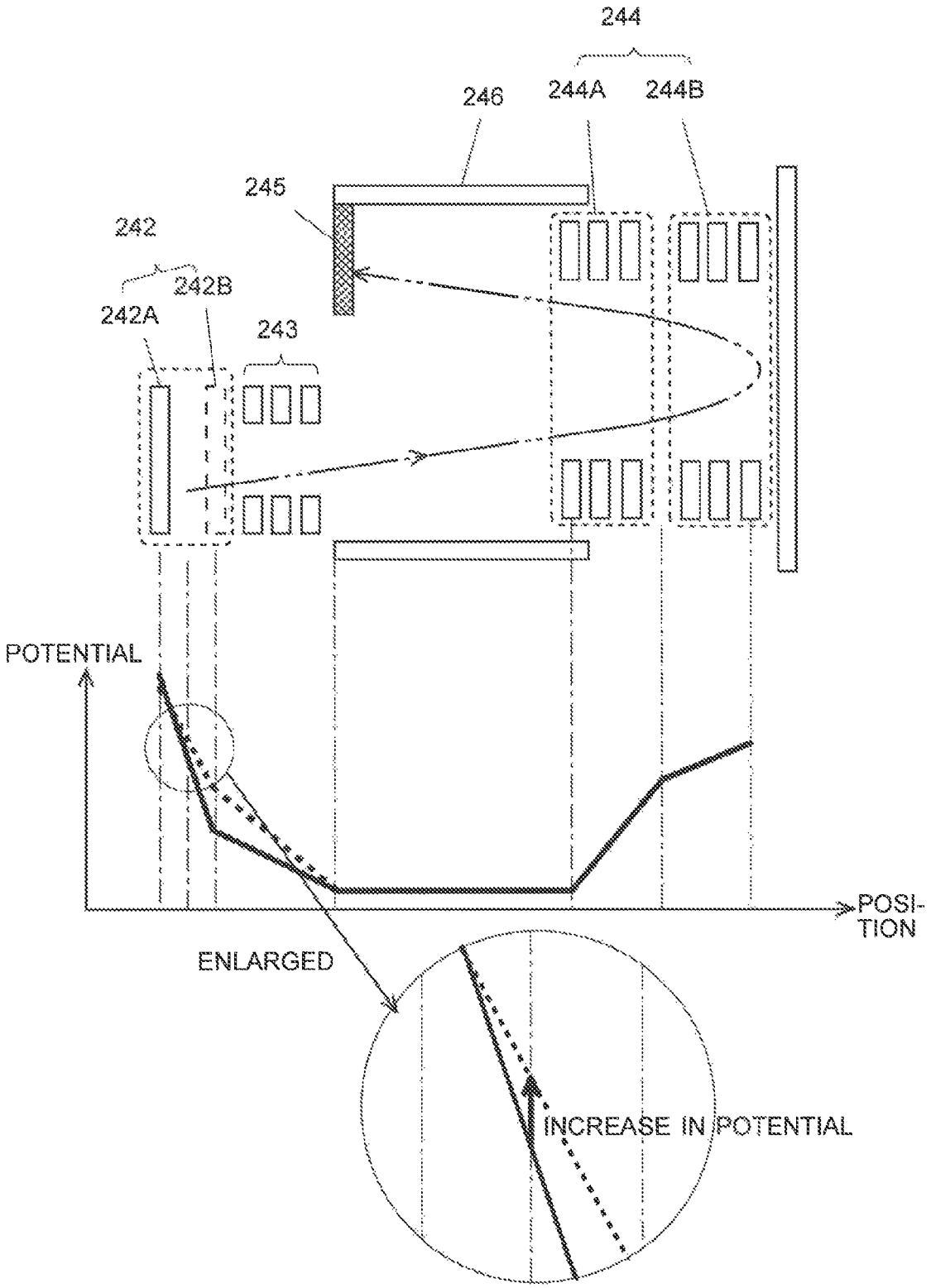
FIG. 10 is a diagram illustrating one example in which the amount of energy imparted to the ions increases due to a voltage drop.

The previous descriptions of the first and second embodiments are examples of the case where the amount of energy imparted to the ions decreases due to the voltage drop at the orthogonal acceleration electrode 242. There is also the case where the amount of energy imparted to the ions increases due to the voltage drop. FIG. 10 shows one such example.

In FIG. 10, the solid line represents the design potential at each section, while the dashed line represents the potential after the voltage drop has occurred at the electrodes 242A and 242B. As in this example shown FIG. 10, if the magnitude of the voltage drop at the electrode 242B is greater than that of the voltage drop at the electrode 242A, the potential within the orthogonal acceleration area becomes higher than the design potential. As a result, a greater amount of energy is imparted to the ions to be accelerated toward the flight space, and the time of flight of the ions becomes shorter. There are various possible causes for the voltage drop at the electrode 242B to be greater than that of the voltage drop at the electrode 242A. For example, it may occur due to the fact that the electrode 242B has a higher stray capacity since this electrode 242B has the electrode 242A located on one side and the acceleration electrode 243 on the other side, while the electrode 242A merely has the electrode 242B located on one side.

In the first and second embodiments, a product ion scan measurement is performed in a liquid chromatograph mass spectrometer. The present invention can be applied in various modes of measurements performed by orthogonal acceleration mass spectrometers with various configurations for determining the mass-to-charge ratio of an ion based on the time of flight of the ion.

REFERENCE SIGNS LIST

1 . . . Liquid Chromatograph Unit
- 10 . . . Mobile Phase Container
- 11 . . . Pump
- 12 . . . Injector
- 13 . . . Column

2 . . . Mass Spectrometer Unit
- 20 . . . Ionization Chamber
  - 202 . . . Heated Capillary
- 21 . . . First Intermediate Chamber
  - 211 . . . Ion Guide
  - 212 . . . Skimmer
- 22 . . . Second Intermediate Chamber
- 23 . . . Third Intermediate Chamber
  - 231 . . . Quadrupole Mass Filter
  - 232 . . . Collision Cell
  - 233 . . . Multipole Ion Guide

234 . . . Ion Guide
24 . . . Analysis Chamber
241 . . . Ion Transport Electrode
242 . . . Orthogonal Acceleration Electrode
243 . . . Acceleration Electrode
244 . . . Reflectron Electrode
245 . . . Detector
246 . . . Flight Tube
4, 40 . . . Control Unit
41, 411 . . . Storage Section
42, 421 . . . Measurement Executer
43, 431 . . . Voltage Supplier
44 . . . Time-of-Flight Determiner
45, 451 . . . Mass-to-Charge-Ratio Determiner
6 . . . Input Unit
7 . . . Display Unit

The invention claimed is:

1. A chromatograph mass spectrometer including a chromatograph in which target components contained in a sample are separated, and an orthogonal acceleration time-of-flight mass spectrometer in which an ion injected into an orthogonal acceleration area is accelerated in a direction orthogonal to a direction of the injection and thereby periodically ejected into a flight space, and a mass-to-charge ratio of the ion is determined based on a time of flight of the ion within the flight space, the mass spectrometer comprising:

an orthogonal acceleration electrode including a pair of electrodes arranged in such a manner as to face each other across an axis of incidence of the injected ion;

a voltage supplier configured to apply a fixed level of voltage to the orthogonal acceleration electrode with a predetermined period, a processor configured to detect an ion after a completion of a flight of the ion within the flight space, determine the time of flight of the ion; and a storage section in which mass determination information which is a set of information defining a relationship between the time of flight and the mass-to-charge ratio of the ion depending on the period of the applied voltage, and a measurement condition file which includes information of a measurement time range, a mass range to be measured, and a period of the applied voltage determined according to the mass range to be measured for each of the target components are stored; wherein the processor is further configured to determine the mass-to-charge ratio of the ion from the time of flight of the ion for each of the target component, based on the relationship between the time of flight and mass-to-charge ratio of the ion corresponding to the period of the applied voltage determined according to the mass range to be measured, the set of information defines multiple relationships between the time of flight and mass-to-charge ratio of the ion, the multiple relationships depending on the period of the applied voltage used in a segment of time in which the ion is detected, and the processor is configured to determine the mass-to-charge ratio of the ion from the determined time of flight of the ion and stored mass determination information.

2. An orthogonal acceleration time-of-flight mass spectrometer in which an ion injected into an orthogonal acceleration area is accelerated in a direction orthogonal to a direction of the injection and thereby periodically ejected into a flight space, and a mass-to-charge ratio of the ion is determined based on a time of flight of the ion within the flight space, the mass spectrometer comprising:

an ion transport electrode for transporting an ion into the orthogonal acceleration area;

an orthogonal acceleration electrode including a pair of electrodes arranged in such a manner as to face each other across the orthogonal acceleration area, for accelerating an ion injected into the orthogonal acceleration area, in the direction orthogonal to the direction of the injection;

a flight-path-defining electrode including a flight tube arranged on an outer edge of the flight space;

a storage section in which applied-voltage information which is a set of information concerning levels of voltages applied to the orthogonal acceleration electrode, the ion transport electrode, and the flight-path-defining electrode is stored, where an applied voltage whose level changes depending on an ion-ejection period is related to at least the orthogonal acceleration electrode, the ion transport electrode, or the flight-path-defining electrode in the applied-voltage information; and a voltage supplier for applying voltages to the orthogonal acceleration electrode, the ion transport electrode, and the flight-path-defining electrode, based on the applied-voltage information;

wherein the set of information including multiple levels of voltages applied to each of the orthogonal acceleration electrode, the ion transport electrode, and the flight-path defining electrode, where the levels of voltage applied to one of the orthogonal acceleration electrode, the ion transport electrode, and the flight-path defining electrode in the applied-voltage information are determined according to the ion-injection period.

3. The orthogonal acceleration time-of-flight mass spectrometer according to claim 2, wherein the applied-voltage information is in a form of a table in which a value of the applied voltage is related to each of a plurality of periods.

* * * * *